US005165640A

United States Patent [19]

Williams, 3rd

[11] Patent Number: 5,165,640

[45] Date of Patent: Nov. 24, 1992

[54] SPRING CLIP FOR PERFORATED BOARD TOOL HOLDERS

[76] Inventor: James W. Williams, 3rd, P.O. Box 336, Gwynedd, Pa. 19436

[21] Appl. No.: 770,923

[22] Filed: Oct. 4, 1991

[51] Int. Cl.[5] ..... E04G 3/00

[52] U.S. Cl. ..... 248/221.2; 248/222.1

[58] Field of Search ..... 248/222.1, 221.2, 220.4, 248/220.3, 221.1, 221.4; 411/182, 508, 913, 104, 174, 175

[56] References Cited

U.S. PATENT DOCUMENTS

| | | | |
|---|---|---|---|
| 2,957,671 | 10/1960 | Messier | 248/221.2 |
| 3,037,732 | 6/1962 | Roman | 248/221.4 X |
| 3,069,122 | 12/1962 | Babajoff | 248/221.2 |
| 3,241,799 | 3/1966 | Terlinde | 248/221.2 |
| 3,789,800 | 2/1974 | Steudler, Jr. | 248/221.4 X |
| 4,928,912 | 5/1990 | Florek | 248/221.2 |

*Primary Examiner*—David L. Talbott

*Attorney, Agent, or Firm*—Synnestvedt & Lechner

[57] ABSTRACT

A clip for securing pegboard toolholders in place on a pegboard comprises a length of spring wire preformed at one end into a helical coil having a plurality of wire turns and a diameter slightly larger than that of a toolholder to permit sliding passage of the clip thereover. The spring wire is preformed into a hook at its other end, and the spring wire intermediate the coil and hook is preformed into a substantially arcuate spring portion having a length slightly less than the pegboard hole spacing. The placement of the clip coil on a toolholder in engagement with the toolholder element extending into a pegboard hole permits by means of the resilient extension of the spring portion, the latching of the clip hook into a pegboard hole below the hole into which the toolholder element is inserted. The clip hook resiliently engages the rear surface of the pegboard to lock the toolholder onto the pegboard by exerting a resilient downward force on the toolholder.

14 Claims, 1 Drawing Sheet

SPRING CLIP FOR PERFORATED BOARD TOOL HOLDERS

BACKGROUND OF THE INVENTION

The present invention relates generally to accessories for perforated board tool holders and relates more specifically to a spring clip for attachment to a tool holder which prevents the dislodging of the tool holder from the board upon removal of a tool therefrom.

Perforated board, also known as pegboard, is widely used in home and commercial shops to support tools or other items on a wall. Tool holders in a wide variety of shapes are available for use with pegboards and allow a customized arrangement of tools or items on a wall surface. The tool holders, typically formed from heavy gauge wire, include an upper end bent in an offset manner for insertion into one hole of the pegboard, and a prong extending inwardly and spaced below the offset end to engage a lower pegboard hole.

Since the typical tool holder includes some form of hook or loop for support of the tool, the removal of the tool from the pegboard unless done very carefully can easily pull the toolholder from the pegboard holes, either partially or completely dislodging it from the pegboard. This is due to the fact that the toolholder, although effectively prevented by the prong from movement in the plane of of the pegboard, has no means for preventing outward movement of its lower end and a disengagement of the prong from its hole. If the toolholder catches on the tool during tool withdrawal, not only the toolholder prong, but also the offset upper end of the toolholder can become disengaged from the pegboard, allowing the toolholder to fall from the pegboard.

SUMMARY OF THE INVENTION

The present invention comprises a clip formed of spring wire which is slid onto the tool holder and which serves to lock the toolholder in place on the pegboard. Specifically, the clip, made from a single length of spring wire, is formed at one end into a helical coil having an internal diameter slightly larger than that of the toolholder to permit sliding passage of the clip thereover. The clip continues from the coil in a fairly sharp "elbow" bend leading into an arcuate spring portion which is offset from the axis of the coil. The clip terminates in a hook at the free end of the spring portion, the hook being sized to pass through a hole in the pegboard for resilient engagement with the rear face of the pegboard.

For use, the clip is placed over the portion of the toolholder which is initially introduced into the pegboard, the coil being disposed around the toolholder portion with the spring portion and hook of the clip being disposed downwardly. The toolholder is then mounted on the pegboard in the usual manner, following which the clip hook is introduced into the hole below that engaged by the toolholder. The spring portion of the clip is resiliently deformed slightly during insertion of the hook to permit the hook to snap into its locking position in engagement with the rear face of the pegboard. In the locked position, the clip exerts a resilient downward force on the toolholder, positively securing the toolholder to the board and preventing accidental toolholder dislodgement upon placement or removal of a tool therefrom.

It is accordingly a first object of the invention to provide a clip for securing a toolholder in position on a pegboard and particularly for preventing dislodgment of the toolholder upon removal of a tool therefrom.

A further object of the invention is to provide a clip as described which does not require any modification of the tool holder or pegboard and which does not interfere with the function of the toolholder.

Another object of the invention is to provide a clip as described which may be easily installed or removed.

A still further object of the invention is to provide a clip as described which is simple, inexpensive, lightweight and unobtrusive.

Additional objects and advantages of the invention will be obvious from the following detailed description of an embodiment of the invention.

DESCRIPTION OF THE PREFERRED EMBODIMENT

Figure 5:
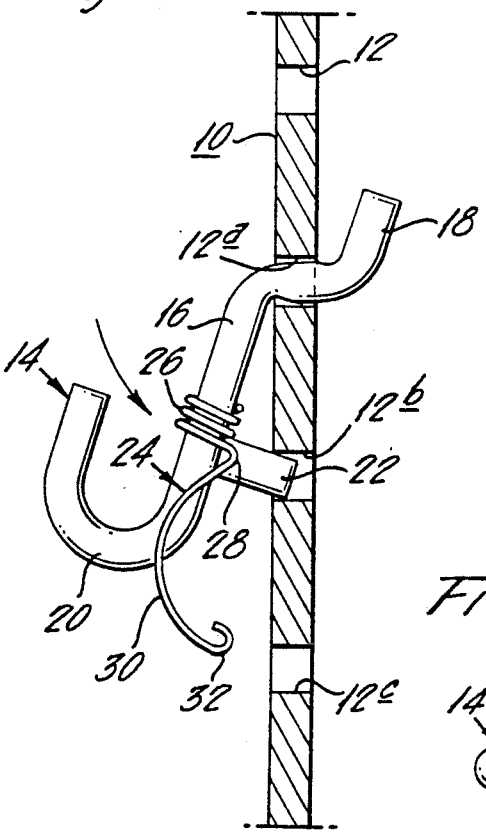
FIG. 5 is a side elevational view of the tool holder and clip of FIGS. 1–4 shown in the process of installation into the holes of a pegboard, the pegboard being shown in section.
Figure 6:
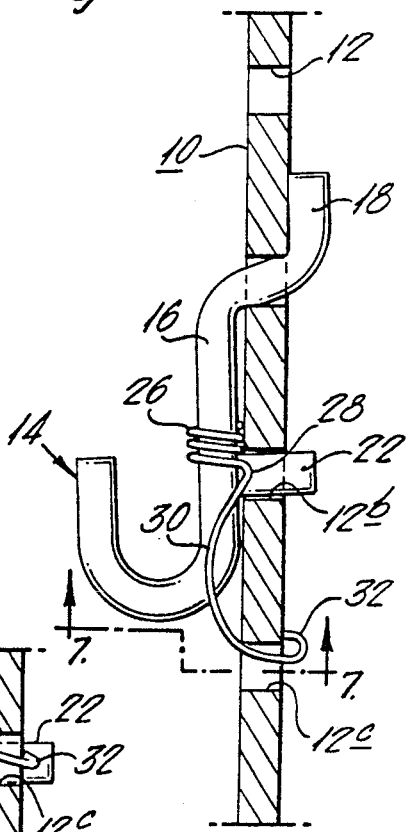
FIG. 6 is a side elevational view similar to FIG. 5 showing the tool holder and clip in the locked position on the peg board.
Figure 7:
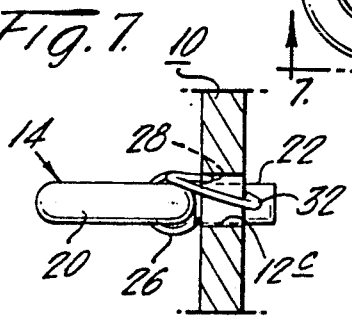
FIG. 7 is view taken along line 7—7 of FIG. 6.

Referring to the drawings, and particularly FIGS. 5–7 thereof, a pegboard 10 is shown in a sectional view taken through a vertical row of round holes 12 therein. Pegboard or perforated board of this type is commercially available in several thicknesses and is characterized by a grid of holes arranged in vertical and horizontal rows of equal spacing. The pegboard is installed in spaced relation to a wall, such a by mounting on studs or spacers, to permit installation and removal of the tool holders.

A typical toolholder 14 is shown in each of the drawing figures and comprises essentially a length of heavy gauge wire bent to form a vertical shank portion 16, an offset upper end 18 and a U-shaped tool supporting portion 20 at its lower end. A prong 22 extends rearwardly from the shank portion 16 and is attached thereto by welding. The tool holder is mounted on the pegboard as shown in FIG. 5 by first inserting the offset portion 18 into a selected one **12*a* of the pegboard holes, and then pivoting the toolholder downwardly to engage the prong 22 into hole 12*b* directly below hole 12*a*. The toolholder is thus positioned as shown in FIG. 6 so as to support the weight of a tool placed on the tool supporting portion 20** thereof.

However, when a tool is removed from the toolholder, unless care is taken to lift the tool upwardly to clear the portion 20 before moving the tool outwardly, the lower end of the tool holder is apt to swing outwardly away from the pegboard into a position such as shown in FIG. 5, with the possibility of the tool holder coming free from the pegboard. When this happens, the tool holder may stay hooked to the tool, or more likely falls to whatever lies below. In either case, the tool holder must be retrieved and remounted on the pegboard, an annoying task, especially if it happens frequently as is apt to be the case. Furthermore, unless the holes are marked, it can be difficult to locate the correct holes for replacing a fallen toolholder.

It should be mentioned that the tool holder shown is only an example of the many different types of commercially available pegboard devices for holding tools or other items. For purposes of this application, such devices are referred to a tool holders although they may have specific applications other than supporting tools. Toolholders are typically sold in hardware stores in bags including a plurality of assorted types of toolholders, some designed for pliers, others for screwdrivers and others for miscellaneous purposes. Regardless of their construction or intended use, pegboard toolholders have in common one or more offset portions such as the portion 18 which are inserted into the pegboard with the toolholder cocked outwardly, such as shown in the example of FIG. 5. When the toolholder is pivoted downwardly, the offset portion or portions become interlocked with the pegboard to support the weight of the tool. The presence of one or more prongs such as the prong 22 in the example shown are useful to prevent rotation of the toolholder and to carry some of the weight of the tool but may not be required if two or more offset portions are present in the same toolholder.

The present invention comprises a clip 24 which is attached to the tool holder and which resiliently latches into a hole in the pegboard to prevent the unwanted outward movement of the toolholder during removal of a tool. The clip 24 comprises a length of spring wire of relatively small diameter, for example; 0.032", which is preformed to provide a helical coil 26 of a plurality of turns at one end thereof. The wire extends tangentially to the coil at one end thereof and is bent at an acute angle to form an elbow 28 extending radially outwardly beyond the helical coil. From the elbow 28, the clip continues in a curved spring portion 30 having a substantially arcuate configuration describing an arc of approximately 90 degrees. At the end of the spring portion 30, the clip wire is formed into a hook 32, the function of which will be presently apparent.

Figure 3:
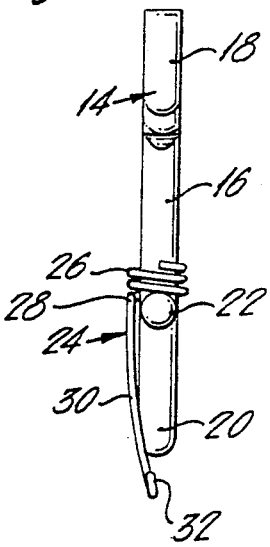
FIG. 3 is a rear elevational view of the tool holder and clip shown in FIGS. 1 and 2.
Figure 4:
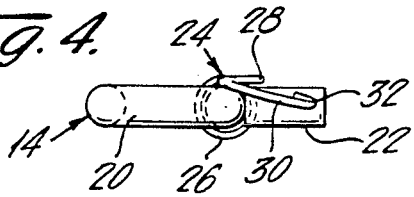
FIG. 4 is a bottom plan view of the tool holder and clip of FIGS. 1–3.

Although the spring portion 30 adjacent the elbow 28 lies substantially in a plane passing through one side of the coil 26, it gradually bends inwardly so that the hook 32 at the end thereof is substantially aligned with a plane passing through the center of the coil as may be seen in FIGS. 3 and 4.

Figure 1:
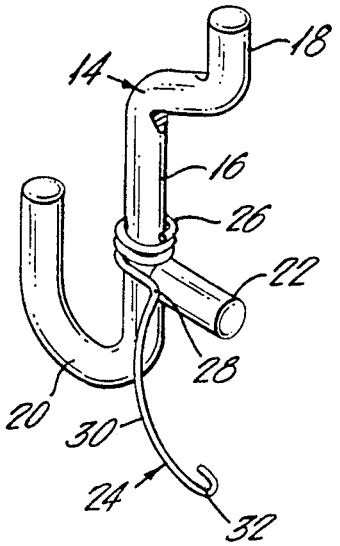
FIG. 1 is a perspective view showing a toolholder equipped with a clip in accordance with the present invention.
Figure 2:
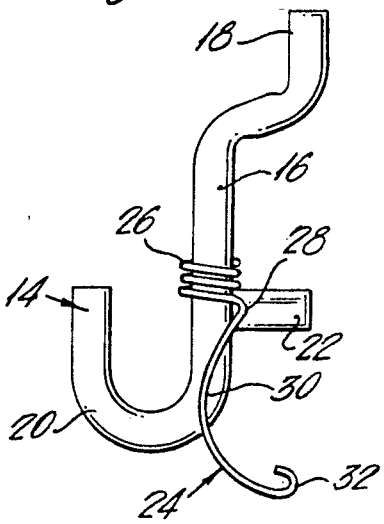
FIG. 2 is a side elevational view of the tool holder and clip shown in FIG. 1.

For use of the invention, the clip 24 with the hook 32 extending downwardly is slipped over the upper end of the toolholder, the coil 26 of the clip being sized to permit easy passage of the coil around the bends of the toolholder offset portion. With the clip coil 26 resting on the prong 22 of the toolholder as shown in FIG. 1, the toolholder is tilted in the manner shown in FIG. 5 to permit insertion of the offset portion 18 into the hole **12*a* of the pegboard 10. The toolholder is then swung downwardly as indicated by the arrow in FIG. 5 to engage the prong 22 thereof with the hole 12*b* lying directly beneath hole 12*a*. Further rotational movement of the toolholder will bring the toolholder into the position of FIG. 6 and by pressing inwardly on the spring portion 30 of the clip, permit the passage of the hook 32 thereof through the hole 12*c* directly beneath hole 12*b*. The hook 32** will resiliently latch onto the rear face of the pegboard, serving to provide a resilient downward force on the toolholder and preventing any substantial outward movement of the lower end of the toolholder during tool removal.

The vertical distance between the elbow 28 of the clip and the hook 32 thereof is somewhat smaller than the spacing between the pegboard holes so that some uncoiling of the clip spring portion is required in order to latch the hook. This places a desirable spring tension on the toolholder and prevents the hook from releasing from the hole. The protrusion of the elbow 28 permits it to extend partially into the hole **12*b* occupied by the prong and this serve to hold the spring portion in vertical alignment. The offset configuration of the spring portion 30** prevents interference with the tool holder, provides finger room to spring the hook into the pegboard hole and additionally allows the clip to accommodate different toolholder shapes without interference.

For removal of the clip-secured tool holder, a screw driver or similar tool is simply placed between the clip spring portion 30 and the pegboard and moved downwardly to disengage the hook 32 from the pegboard hole. The toolholder is then pivoted in the usual fashion to remove it and the clip from the pegboard. The clip may, of course, be repeatedly reused.

When the tool holder does not employ a prong or prongs, the clip may be place on the offset portion and hooked into the hole directly below that occupied by the offset portion. If such a toolholder employs two offset portions, two clips are desirably employed for extra toolholder security.

Manifestly, changes in details of construction can be effected by those skilled in the art without departing from the invention.

I claim:

1. A clip for securing pegboard toolholders in place on a pegboard having uniformly spaced holes therethrough and wherein the toolholders each have at least one element adapted for entry into one of the pegboard holes, comprising a length of spring wire preformed at one end into a helical coil having a diameter slightly larger than that of a toolholder to permit sliding passage of the clip thereover, said spring wire being preformed into a hook at the other end thereof, said spring wire intermediate said coil and said hook being preformed into a substantially arcuate spring portion, said spring portion serving to dispose said hook a distance from said coil which is slightly less than the pegboard hole spacing whereby placement of the clip coil on a toolholder in engagement with the toolholder element permits by means of the resilient extension of said spring portion the latching of the clip hook into a pegboard hole below the hole into which the toolholder element is inserted, the clip hook resiliently engaging the rear surface of the pegboard to thereby lock the toolholder onto the pegboard by exerting a resilient downward force on the toolholder.

2. The invention as claimed in claim 1, wherein said clip arcuate spring portion describes an arc of substantially 90°.

3. The invention as claimed in claim 1, wherein said coil joins said arcuate portion at an acute angle bend forming an elbow which extends radially beyond said coil.

4. The invention as claimed in claim 1, wherein said hook comprises substantially a 180° bend in the clip wire.

5. In combination, a pegboard toolholder and a clip for securing said toolholder in place on a pegboard having uniformly spaced holes therethrough, said tool holder comprising at least one element adapted for insertion into a pegboard hole, said clip comprising a length of spring wire preformed at one end into a helical coil having a plurality of wire turns, said helical coil having a diameter slightly larger than that of said toolholder to permit sliding passage of the clip thereover, said spring wire being preformed into a hook at the other end thereof, said spring wire intermediate said coil and said hook being preformed into a substantially arcuate spring portion, said spring portion serving to dispose said hook a distance from said coil which is slightly less than the pegboard hole spacing whereby placement of the clip coil over the toolholder in engagement with said element permits by means of the resilient extension of said spring portion the latching of the clip hook into a pegboard hole below the hole into which the toolholder element is inserted, the clip hook resiliently engaging the rear surface of the pegboard to thereby lock the toolholder onto the pegboard by exerting a resilient downward force on the toolholder.

6. The invention as claimed in claim 5, wherein said clip arcuate spring portion describes an arc of substantially 90°.

7. The invention as claimed in claim 5, wherein said coil joins said arcuate portion at an acute angle bend forming an elbow which extends radially beyond said coil.

8. The invention as claimed in claim 5, wherein said hook comprises substantially a 180° bend in the clip wire.

9. In combination, a pegboard toolholder and a clip for securing said toolholder in place on a pegboard, said tool holder comprising at least one element adapted for insertion into a pegboard hole and a prong spaced from said element so as to engage a hole of the pegboard below that engaged by said element, said clip comprising a length of spring wire preformed at one end into a helical coil having a plurality of wire turns, said helical coil having a diameter slightly larger than that of said toolholder element to permit sliding passage of the clip thereover, said spring wire being preformed into a hook at the other end thereof, said spring wire intermediate said coil and said hook being preformed into a substantially arcuate spring portion, said spring portion serving to dispose said hook a distance from said coil which is slightly less than the pegboard hole spacing whereby placement of the clip coil on the toolholder in engagement with said prong permits by means of the resilient extension of said spring portion the latching of the clip hook into a pegboard hole below the hole into which the toolholder prong is inserted, the clip hook resiliently engaging the rear surface of the pegboard to thereby lock the toolholder onto the pegboard.

10. In combination, a pegboard, a toolholder adapted for connection to said pegboard, and a clip for securing said toolholder in place on said pegboard, said pegboard comprising a rigid board having a grid of equally spaced holes therein, said toolholder comprising at least one element adapted for insertion into a pegboard hole, said clip comprising a length of spring wire preformed at one end into a helical coil having a plurality of wire turns, said helical coil having a diameter of slightly larger than that of said toolholder element to permit sliding passage of the clip thereover, said spring wire being preformed into a hook at the other end thereof, said spring wire intermediate said coil and said hook being preformed into a substantially arcuate spring portion, said spring portion serving to dispose said hook a distance from said coil which is slightly less than the pegboard hole spacing whereby placement of the clip coil over the toolholder element permits by means of the resilient extension of said spring portion the latching of the clip hook into a pegboard hole below the hole into which the toolholder element is inserted, the clip hook resiliently engaging the rear surface of the pegboard to thereby lock the toolholder onto the pegboard by exerting a resilient downward force on the toolholder.

11. The invention as claimed in claim 10, wherein said clip arcuate spring portion described an arc of substantially 90°.

12. The invention as claimed in claim 10, wherein said coil joins said arcuate portion at an acute angle bend forming an elbow which extends radially beyond said coil, said elbow being adapted to extend partially into the pegboard hole with said toolholder element.

13. The invention as claimed in claim 10, wherein said hook comprises substantially a 180° bend in the clip wire.

14. In combination, a pegboard, a toolholder adapted for connection to said pegboard, and a clip for securing said toolholder in place on said pegboard, said pegboard comprising a rigid board having a grid of equally spaced holes therein, said toolholder comprising at least one element adapted for insertion into a pegboard hole, said toolholder further including a prong spaced from said element so as to engage a hole of said pegboard below that engaged by said element, said clip comprising a length of spring wire preformed at one end into a helical coil having a plurality of wire turns, said helical coil having a diameter slightly larger than that of said toolholder to permit sliding passage of the clip thereover, said spring wire being preformed into a hook at the other end thereof, said spring wire intermediate said coil and said hook being preformed into a substantially arcuate spring portion, said spring portion serving to dispose said hook a distance from said coil which is slightly less than the pegboard hole spacing whereby placement of the clip coil over the toolholder in engagement with the top of said prong permits by means of the resilient extension of said spring portion the latching of the clip hook into a pegboard hole below the hole into which said prong is inserted, the clip hook resiliently engaging the rear surface of the pegboard to thereby lock the toolholder onto the pegboard.

* * * * *